United States Patent [19]

Jacobson

[11] Patent Number: 4,691,613

[45] Date of Patent: Sep. 8, 1987

[54] BASS DRUM PEDAL

[76] Inventor: Luke Jacobson, Box 115, Grenora, N. Dak. 58845

[21] Appl. No.: 912,415

[22] Filed: Sep. 29, 1986

[51] Int. Cl.[4] ..... G10D 13/00

[52] U.S. Cl. ..... 84/422 R

[58] Field of Search ..... 84/422

[56] References Cited

U.S. PATENT DOCUMENTS

| | | | |
|---|---|---|---|
| 2,445,486 | 7/1948 | La Londe | 84/422 R |
| 2,800,828 | 7/1957 | Moeller | 84/422 |
| 3,030,847 | 4/1962 | Thompson | 84/422 |
| 3,439,574 | 4/1969 | Ramsey | 84/422 R |
| 3,563,129 | 2/1971 | Cantrell | 84/422 |
| 3,797,356 | 3/1974 | Duffy et al. | 84/422 |
| 3,930,431 | 1/1976 | Magadini | 84/422 |
| 4,048,896 | 9/1977 | Calato et al. | 84/422 |
| 4,186,644 | 2/1980 | Kurosaki | 84/422 |
| 4,188,853 | 2/1980 | Bills | 84/422 R |
| 4,200,025 | 4/1980 | Currier | 84/422 R |
| 4,235,146 | 11/1980 | Purdy | 84/422 |
| 4,346,638 | 8/1982 | Hoshino | 84/422 |
| 4,538,499 | 9/1985 | Livingston | 84/422 |
| 4,567,808 | 2/1986 | Smith | 84/422 R |

FOREIGN PATENT DOCUMENTS

| | | | |
|---|---|---|---|
| 646530 | 10/1962 | Italy | 84/422 R |

*Primary Examiner*—Lawrence R. Franklin

*Attorney, Agent, or Firm*—Zarley, McKee, Thomte, Voorhees & Sease

[57] ABSTRACT

A bass drum pedal includes a base frame with a pivotal footplate assembly for driving a rotatable shaft supported on the frame. A hammer is connected to the drive shaft, and is moved to impact on a drum head. A cable connects the footplate to a generally spiral shaped torque arm mounted to the drive shaft. The torque arm is adjustable to vary the amount of footplate movement per unit of hammer sweep. A spring and chain are connected between the frame and drive shaft to return the hammer to a resting position after being operated to impact on the drum. A pair of sprockets are eccentrically mounted with the chain wrapped around them such that the amount of footplate movement per unit of total spring tension can be increased or decreased throughout the hammer stroke. The footplate assembly includes a heel plate, arch plate and toe plate each adjustably attached to a pair of rails pivotally connected to the base frame at the heel end. The heel, arch and toe plates are specially contoured to support the foot and prevent "cupping" and rolling of the foot during high speed playing. An acoustic drum simulator assembly adjustably secured to the drive shaft is connected to one end of a coil spring wrapped around the drive shaft. The other end of the coil spring is attached to a collar which holds the hammer. The spring allows a limited amount of additional rotation of the drive shaft past the point at which the hammer contacts the drum head, to thereby simulate the feel of an acoustic drum when utilizing the pedal on an electronic drum.

11 Claims, 9 Drawing Figures

BASS DRUM PEDAL

TECHNICAL FIELD

The present invention relates generally to bass drum pedals, and more particularly to a bass drum pedal with features for improving the performance of the pedal and adapted for adjustability of the various components and drive mechanisms of the pedal.

BACKGROUND OF THE INVENTION

Bass drum pedals have been the subject of many patents. Yet, this relatively simple device has been continuously improved in many different ways, and is yet capable of more improvements.

State of the art bass drum pedals use a variety of methods for driving a hammer against a drum, but all of them utilize a drive shaft connected to a pivotable footplate. These pedals generally are constructed such that the ratio of the change in footplate angle to the change in drive shaft rotation (or amount of "sweep" of the hammer) is constant throughout a single stroke. However, such pedals are not easily adaptable to a wide variety of users, i.e., they do not allow this ratio to be adjusted in any way. Thus, a player could not increase the amount of footplate angle displacement relative to the sweep of the hammer. Such an adjustment is desirable, since a player may want more momentum, or a louder beat, without having to pivot the foot through a great distance for each stroke. Similarly, a player may wish to play very rapidly without having to wait for the hammer to return a great distance between strokes. These situations require that the total amount of angle through which the footplate will pivot be adjustable in relation to a constant amount of hammer sweep.

Furthermore, it is desirable to vary the above described ratio throughout the stroke. In this way, pivotal movement of the footplate will cause greater movement of the hammer near the end of the stroke than at the beginning of the stroke, or vice versa. Again, this would allow the user to define that portion of the stroke where he desires the hammer to move fastest in relation to a constant amount of footplate movement. None of the prior art devices are capable of such a wide variety of adjustments.

State of the art pedals also lack the universal adjustability desirable in the return spring for the hammer. While it is known that it is beneficial to increase the spring tension as the hammer approaches the drum head, it is also desirable to increase the total distance through which the spring is stretched for a given amount of spring tension. An increase in this distance would allow a lighter weight and gauge of spring to do a greater amount of work than a conventional spring.

Furthermore, the prior art devices are not capable of adjusting the speed at which the tension increases, or in "fine tuning" the point of maximum tension increase to a specific position within the stroke. Such capabilities would allow universal adjustability for a bass drum pedal. Thus, the user may want to locate a rapid buildup of spring tension in the last portion of the stroke, allowing the first portion of the stroke to be used to develop speed and momentum. A more rapid return of the hammer after impact with the drum head allows the bass drum to be played at higher speeds.

The footplate on prior art bass drum pedals is conventionally a flat plate having the general outline of a foot. If large enough, such a plate may be used by many different drum players. However, such plates are quite heavy, thereby adding to the weight which the return spring on the pedal must overcome, and also slowing the return of the hammer after impact on the drum head. Also, a flat pedal cannot overcome the natural tendency for the drummer's foot to "cup" when playing at faster speeds. Since most players use soft shoes while playing, this cupping occurs as the toes curl under, pulling the muscles of the lower leg out of desirable position for drumming. Also, on a flat footplate, the foot tends to roll to the arched-side of the foot during high speed playing, which also pulls the leg out of desirable drumming position.

Yet another problem with prior art bass drum pedals is in their use on an electronic drum. A conventional "acoustic" drum has a plastic material stretched over a rim to form the head. When a bass drum pedal is used with such a drum, the head will stretch and deviate from its planar position up to one-half to three-fourth inch when the hammer strikes. Most electronic drums have a striking surface of thick plywood covered by a non-stretching plastic material. Thus, when a conventional bass drum pedal is utilized on an electronic drum, none of the resilience of the acoustic drum head is present. This unyielding surface can actually be painful to a user over a period of time, and has been likened to "kicking a brick".

It is therefore an object of the present invention to provide an improved bass drum pedal.

Another object is to provide a bass drum pedal upon which the total amount of footplate pivot throughout a stroke may be adjusted in relation to the total amount of hammer sweep. Another object is to provide a pedal upon which the ratio of the change in footplate angle per unit of hammer sweep is adjustable to be increasing or decreasing throughout the stroke.

Still another object is to provide a bass drum pedal with a spring return which may be universally adjusted to provide an increasing or decreasing ratio of hammer sweep per unit of total tension applied to the hammer throughout the stroke.

Another object of the present invention is to provide a bass drum pedal with a dramatically increased stretching distance for the return spring in comparision to conventional pedals.

Another object is to provide a bass drum pedal capable of adjusting the point at which maximum spring tension increase per unit of sweep is located.

Still another object is to provide a bass drum pedal with a footplate which prevents "cupping" of the foot during playing.

Another object is to provide a bass drum pedal with a footplate which is adjustable in length.

Another object is to provide a pedal which is lightweight and adaptable for use by many players.

Another object of the present invention is to provide a bass drum pedal which can be utilized on an electronic drum while still giving the "feel" of an acoustic drum.

Another object of the present invention is to provide a bass drum pedal which will not transmit the shock of striking an unyielding surface directly to the user's foot.

These and other objects will be apparent to those skilled in the art.

SUMMARY OF THE INVENTION

A bass drum pedal is described which includes a base frame having a heel end and a toe end, the toe end supporting a pair of upstanding support members which hold a rotatable drive shaft. A hammer is connected to the drive shaft, and is moved to impact on a drum head. A cable is wrapped around a generally spiral shaped torque arm mounted to the drive shaft to move the hammer, and is adjustable to vary the amount of footplate movement per unit of hammer sweep. A spring is connected between an extending arm of one of the base frame support members and a chain connected to a sprocket on the drive shaft. A second sprocket is rotatably mounted below the first sprocket, the chain being wrapped clockwise about the upper sprocket and counterclockwise about the lower sprocket. Both sprockets are eccentrically mounted such that the amount of footplate movement per unit of total spring tension is increased or decreased throughout the hammer stroke. The footplate includes a heel plate, arch plate and toe plate each adjustably attached to a pair of rails pivotally connected to the base frame at the heel end. The heel, arch and toe plates are specially contoured to support the foot and prevent "cupping" and rolling of the foot during the high speed playing. An acoustic drum simulator assembly includes a collar which is releasably rotatably secured to the drive shaft and is connected to one end of a coil-like spring wrapped around the drive shaft. The other end of the coil spring is attached to a collar which holds the hammer. The spring allows a limited amount of additional rotation of the drive shaft past the point at which the hammer contacts the drum head.

DESCRIPTION OF THE PREFERRED EMBODIMENT

Figure 1:
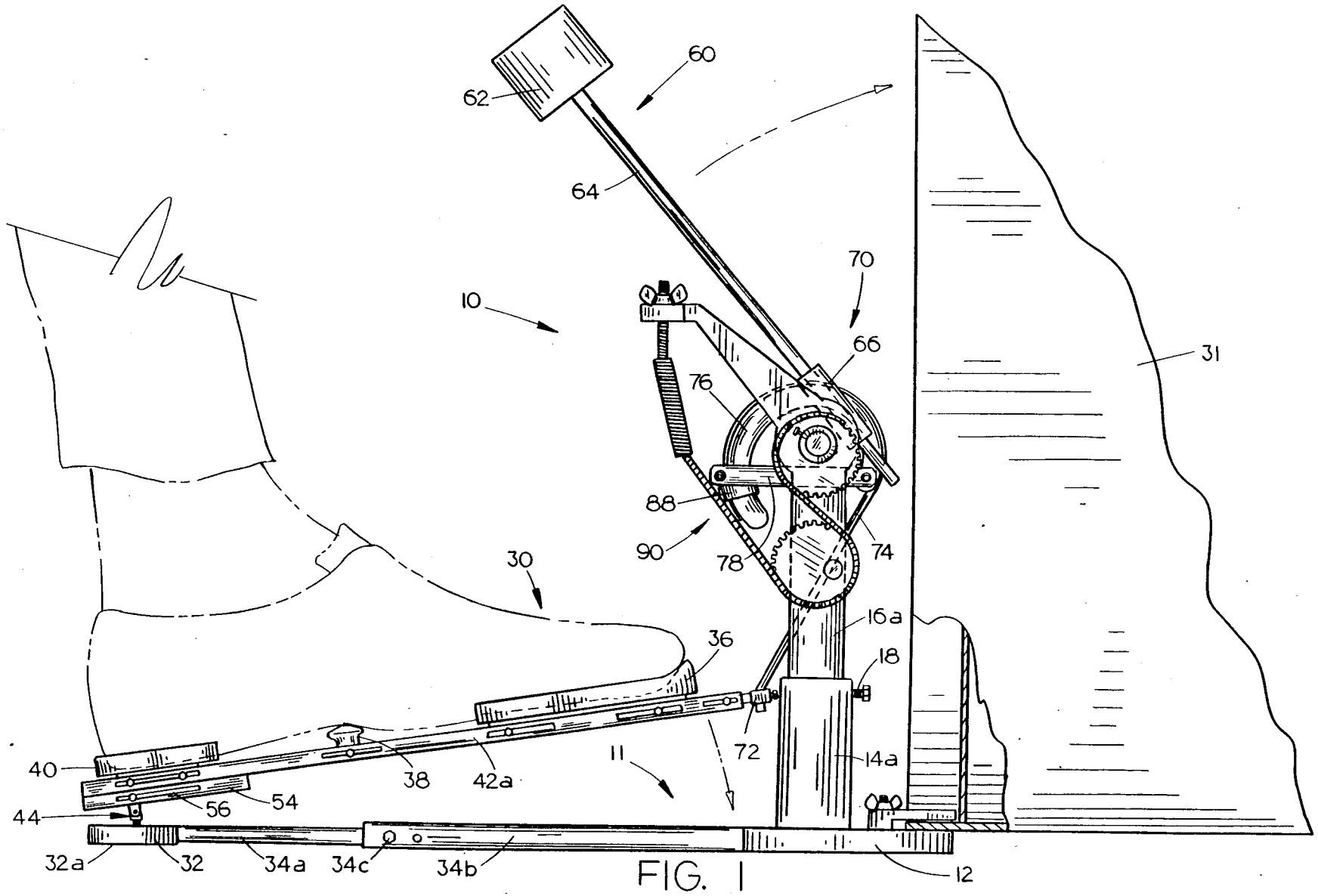
FIG. 1 is an elevational view of the right side of the invention, as mounted on a drum.

Referring now to the drawings, in which similar or corresponding parts are designated by the same reference character throughout the several views, the bass drum pedal of this invention is designated generally at 10, and includes a frame 11 upon which is mounted a footplate assembly 30, a drive assembly 70, a return spring assembly 90, and an acoustic drum simulator assembly 100.

Frame 11 includes a base 12 having a pair of upright sleeves 14*a* and 14*b* mounted thereon. One sleeve 14*a* slidably holds a generally vertically oriented right support member 16*a*, the other sleeve 14*b* slidably holding a left support member 16*b*. A set screw 18 in each sleeve 14*a* and 14*b* allows the vertical height of each support member 16*a* and 16*b* to be selectably adjusted.

Figure 2:
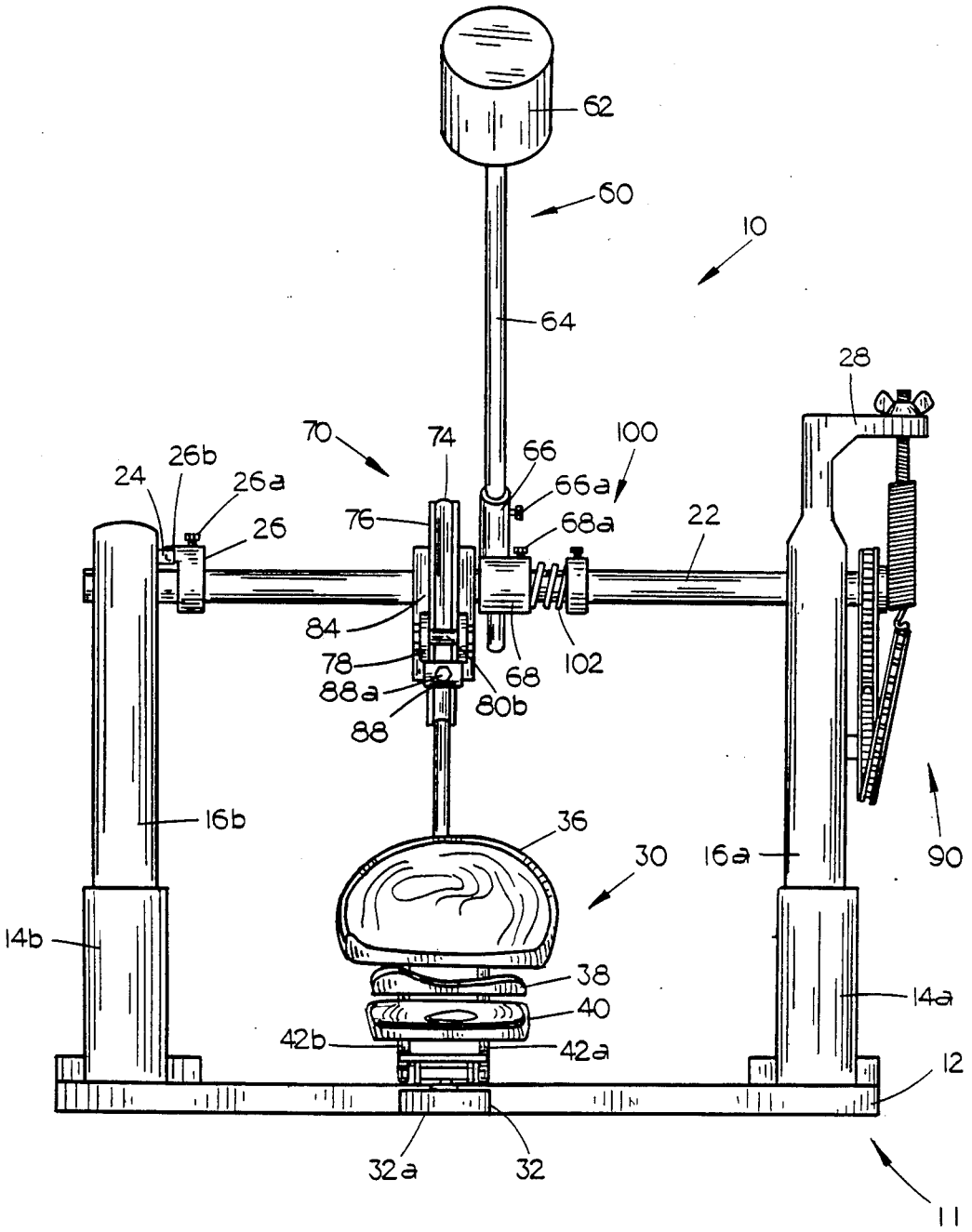
FIG. 2 is a front elevational view of the invention, looking toward a drum from the heel end of the pedal.
Figure 3:
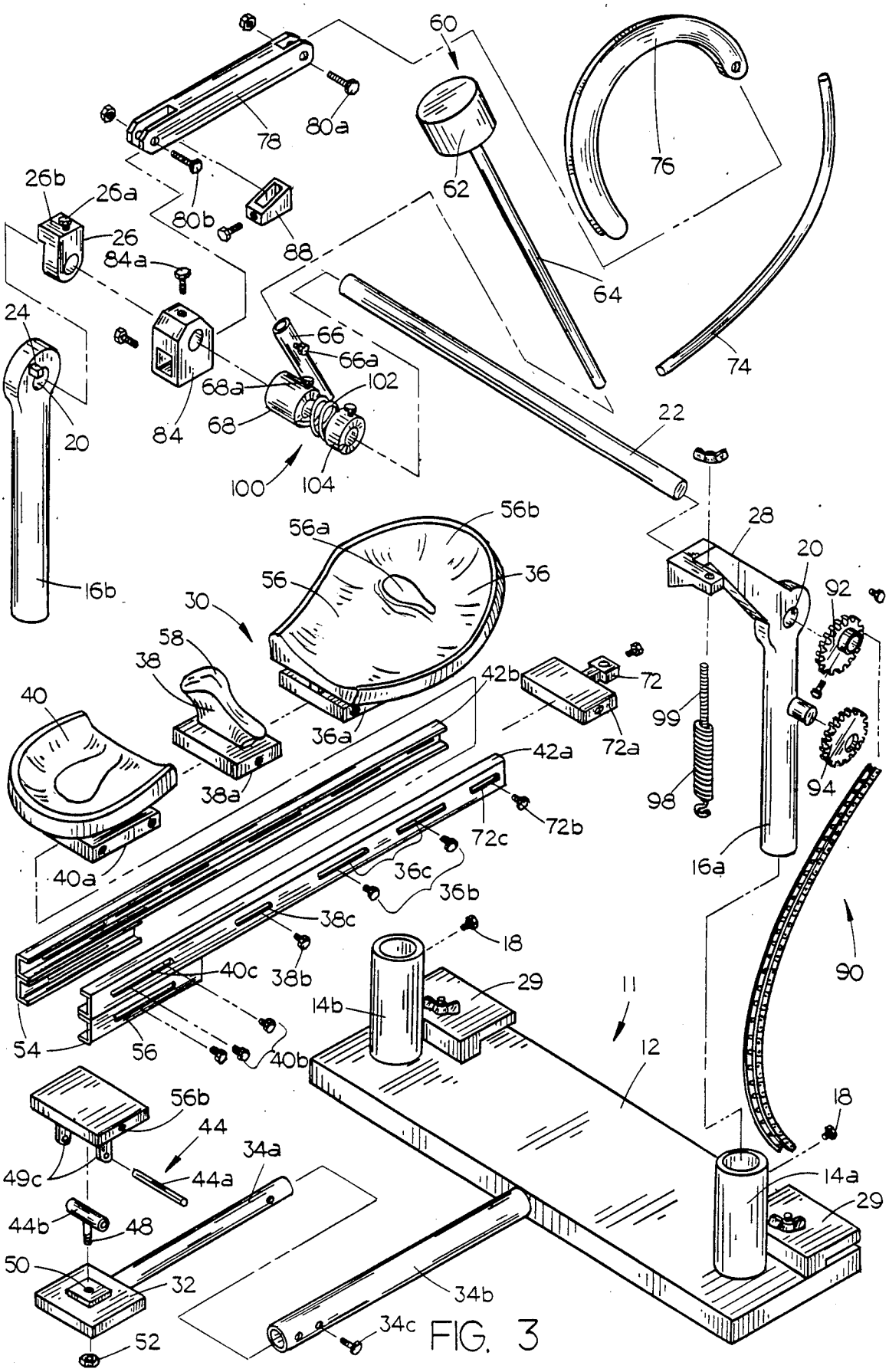
FIG. 3 is an exploded view of the pedal of the invention.

Support members 16*a* and 16*b* have an aperture 20 at their upper ends which are coaxial and support a rotatable drive shaft 22 therebetween. Drive shaft 22 supports the drive assembly 70, as will be described in more detail hereinbelow. Left support member 16*b* has a projecting prong 24 (as seen in FIG. 2) located parallel and adjacent to drive shaft 22. A collar 26 selectively rotatably mounted on drive shaft 22 with a set screw 26*a* has a projecting stop 26*b* which corresponds with prong 24. When set screw 26*a* is fastened against drive shaft 22, collar 26 will rotate with drive shaft 22. It can be seen that prong 24 will contact stop 26*b* and thereby stop rotation of shaft 22. In this way collar 26 will act as an adjustable back check for the drive shaft 22.

Right support member 16*a* has an arm 28 projecting upwardly therefrom which is used in conjunction with the return spring assembly 90 as will be described in more detail hereinbelow.

A pair of brackets 29, mounted to frame 11 are tightened onto the lip of a drum 31 to hold frame 11 in a position on the drum.

Frame 11 serves to connect footplate assembly 30 in adjustable relation to drive shaft 22. A heel plate block 32 is generally rectangular and has a roughened bottom surface 32*a* for gripping contact with a floor surface. Block 32 is held an adjustable distance from base 12 via a pair of extension members 34*a* and 34*b*, one of which telescopes within the other. The opposing ends of the extension members 34*a* and 34*b* are connected to block 32 and base 12, to hold block 32 generally centered between support members 16*a* and 16*b* along a line perpendicular to drive shaft 22. A set screw 34*c* journaled within extension member 34*b* will fasten against member 34*a* to selectively hold it in position.

A set of three plates—toe plate 36, arch plate 38, and heel plate 40—are adjustably connected to a pair of rails 42*a* and 42*b* which are adjustably and pivotally connected to heel block 32. A hinge assembly 44—consisting of a pin 44*a* within a sleeve 44*b*, the sleeve 44*b* being journaled between a pair of brackets 49*c*—depends from a pivot block 46, and has its sleeve 44*b* mounted to the top of a threaded screw 48. A threaded aperture 50 within heel plate block 32 receives screw 48 so that pivot block 46 is vertically adjustable. A lock nut 52 will hold screw 48 in the desired position in heel plate block 32. Pivot block 46 is longitudinally slidable and journaled between a pair of short rails 54. Short rails 54 have longitudinal slots 56 in their sides which corresponds to set screws 56*a* in combination with apertures 56*b* in the sides of pivot block 46, such that rails 54 are selectively adjustably positioned along the sides of block 46.

Short rails 54 depend from the rearward end of rails 42*a* and 42*b*. Rails 42*a* and 42*b* are adjustably pivotally connected to the drive assembly 70 in a manner to be described in more detail hereinbelow. Toe, arch and heel plates 36, 38 and 40, each have a depending member 36*a*, 38*a* and 40*a*, respectively, slidably journaled between rails 42*a* and 42*b*. A combination of set screws 36*b*, 38*b*, 40*b* and slots 36*c*, 38*c*, and 40*c* in conjunction with portions 36*a*, 38*a* and 40*a* respectively, allow independent longitudinal slidable adjustment of the toe, arch and heel plates 36, 38 and 40.

The upper surface of toe, arch and heel plates 36, 38 and 40, are specifically contoured to promote proper positioning of the drummer's foot, and to resist the tendency of the foot to "cup" when using the pedal. A natural tendency of the foot is to curl the toes when it is necessary to play the drum at high speed. The faster the foot is moved the more cupping that occurs. As the toes curl under they pull the muscles of the lower leg out of the desired position for continuous action, making it more difficult to play the drum quickly. The contoured face 56 of toe plate 36, resists these tendencies. A depression 56*a* is generally located for the ball of the foot, and the forward portion 56*b* under the toes is sloped upwards to the edge, so that the toes cannot easily curl.

The foot also has a tendency to roll towards the inside edge of the foot during high speed playing. Although the contour of the top plate 36 helps to reduce this affect, the arch plate 38 and heel plate 40 are specifically contoured to assist in preventing this effect. The arch plate 38 has an upper surface 58 which rises up in what would be the inside of the arch of the user's foot. Thus, the foot is supported and resists any "roll" in that direction. The heel plate 40 has a depression for the heel. This fit resists the roll of the foot as well. Since each plate is separate and adjustable along rails 42*a* and 42*b*, the three plates are easily moved to fit any shape or length of foot.

A hammer assembly 60 is connected to drive shaft 22 and is used to impact on the head of drum 31. The hammer assembly 60 includes a hammer 62 fastened to the end of a hammer shaft 64 which is adjustably mounted within a sleeve 66 connected to drive shaft 22 via collar 68. Sleeve 66 is rigidly mounted to collar 68, and has a set screw 66*a* journaled to adjustably hold shaft 64. Collar 68 also has a set screw 68*a* to selectively fasten collar 68 to the drive shaft 22.

The drive assembly 70 will transmit the energy from footplate assembly 30 to hammer assembly 60. A slidable bracket 72 is connected between the forward ends of rails 42*a* and 42*b* and holds one end of a drive belt 74 which extends upward and is wrapped around torque arm 76. Slidable bracket 72 may be adjustably set between rails 42*a* and 42*b* using a set screw 72*b* journaled through a slot 72*c* in rails 42*a* and 42*b* and into a slidable block 72*a* attached to bracket 72. The torque arm 76, discussed below, is adjustably attached to drive shaft 22, and will thereby cause the hammer 62 to move.

The resting position for the hammer 62 is set using collar 26 and set screw 26*a* in cooperation with the back check prong 24, as described above. Once this is set the drive assembly 70 may be adjusted in a variety of ways.

Torque arm 76 is formed in the shape of a section of a spiral, one end 76*b* being curved to a small radius while the other end 76*c* has a large radius. The remainder of torque arm 76 has a radius uniformly increasing from end 76*b* to end 76*c*. This unique shape is utilized in combination with the other adjustable characteristics of bass drum pedal 10 to create a device which is nearly universally adjustable.

Torque arm 76 is pivotally connected at small radius end 76*b* within a slot 78*a* in one end of an adjustment arm 78. Arm 78 has a slot at its other end 78*b* through which large radius end 76*c* of torque arm 76 will slide, as indicated by arrow 82. A screw 80*a* pivotally connecting torque arm 76 to arm 78 may be tightened such that the two pieces will no longer pivot. A screw 80*b* in the other end of arm 78 will clamp arm 78 tightly to torque arm 76 such that large radius end 76*c* will no longer slide therethrough.

Adjustment arm 78 is selectively, slidably journaled through torque arm collar 84, and can be adjusted perpendicularly to the axis of drive shaft 22, as indicated by arrow 85. Torque arm collar 84 is fastened onto drive shaft 22 with a set screw 84*a*. Thus, collar 84 may be adjusted to various positions on drive shaft 22, shown by arrow 86, and then fastened in position. Belt 74 is positioned in a groove 76*d* along the outer perimeter of torque arm 76 and is fastened to the large radius end 76*c* with clamp 88. Clamp 88 has an aperture through which the large radius end 76*c* of torque arm 76 is journaled. A set screw 88*a* is positioned over cable 74 in groove 76*d*, and is fastened to hold cable 74 and clamp 88 in position on torque arm 76.

Figure 4:
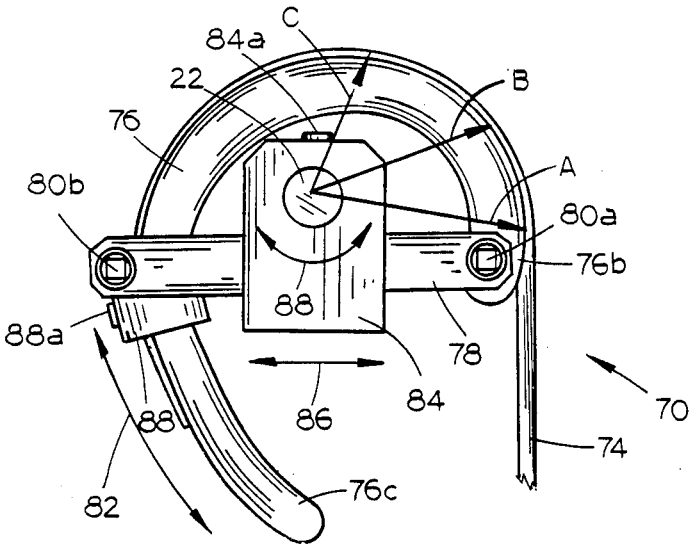
FIG. 4 is an enlarged side view of the torque arm of the pedal.
Figure 5:
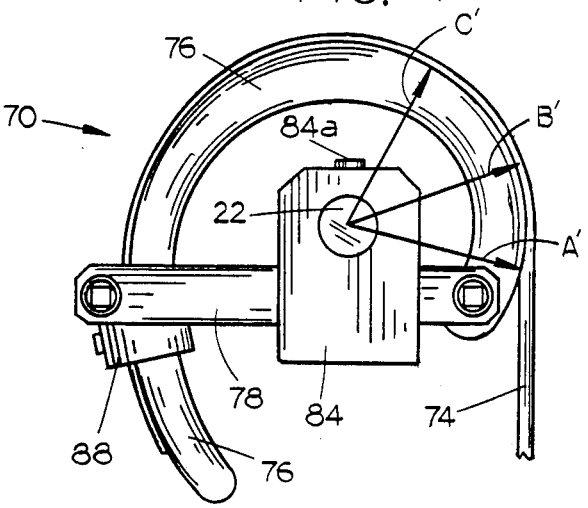
FIG. 5 is an enlarged side view of the torque arm of the pedal, the torque arm being readjusted to another position.
Figure 6:
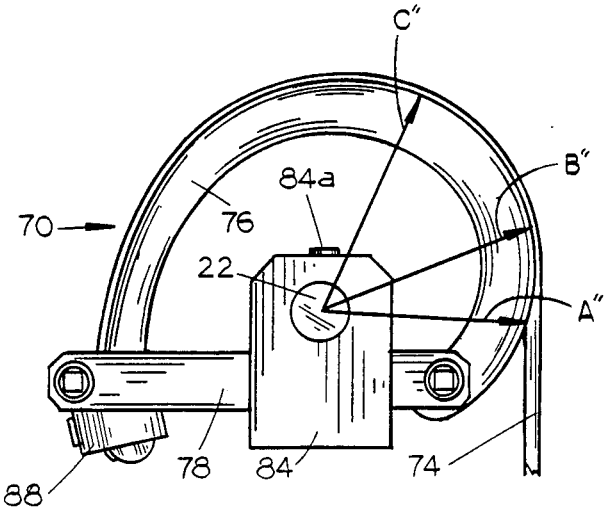
FIG. 6 is an enlarged side view of the torque arm of the pedal. The torque arm being readjusted to yet another position.

Referring to FIGS. 4–6, the different ratio of hammer sweep (via drive shaft rotation) per unit of footplate movement are shown in the various adjustments of the torque arm 76 and adjustment arm 78.

In FIG. 4, adjustment arm 78 is moved to the right, relative to torque arm collar 84, so that small radius end 76*b* of torque arm 76 is at its farthest point from drive shaft 22. Also, the large radius end 76*c* of torque arm 76 is extended through the other end of adjustment arm 78 such that only a minimal amount of the torque arm 76 extends above drive shaft 22 between the ends of adjustment arm 78. In this position it can be seen that the ratio of drive shaft rotation per unit of footplate movement will decrease throughout the stroke, as the distance between the drive shaft 22 and the point of tangency of belt 74 with torque arm 76 decreases. This distance is shown by arrow A when the hammer is at rest, by arrow B midway through the stroke, and by arrow C at the point of impact. Thus, there will be a relatively large amount of hammer sweep per unit of footplate movement at the beginning of the stroke; the amount of hammer sweep decreasing in relation to footplate movement to a very small amount at the end of the stroke.

In FIG. 5, adjustment arm 78 is moved such that the small radius end of 76*b* of torque arm 76 is closer to drive shaft 22. Also, the large radius end 76*c* of torque arm 76 is moved upwardly within slot 78*a* of adjustment arm 78 in order to increase the height of the torque arm over the drive shaft 22. In this position, arrows A′, B′ and C′ are of nearly the same length, such that the amount of hammer sweep per unit of footplate movement will be nearly constant throughout the stroke.

In FIG. 6, adjustment arm 78 is moved completely to the right, closest to the small radius end of 76*b* of torque arm 76 and the height of torque arm 76 is increased to its greatest height. In this position, the amount of hammer sweep per unit of footplate movement will increase throughout the stroke to the point of impact. This is seen in the increasing lengths of arrows A″, B″, and C″. If the torque arm 76 is repositioned by rotating it in a clockwise direction on the shaft, the amount of hammer sweep per unit of footplate movement will again increase throughout the stroke. However, the rate of increase will be less, since the stroke will begin at a point where the distance between the drive shaft 22 and point of tangency will already be greater than the distance in the initial part of the stroke in FIG. 6. In this way the user can vary the length of the footplate stroke, and also vary the amount he wishes the hammer to accelerate through the stroke; *and,* he can vary the point at which this acceleration is to occur.

Once the proper amount of sweep and ratio of sweep to footplate motion is set, the drummer can adjust the angle at which the footplate 30 will be located when the hammer 62 is at the point of impact on the drum head. This is accomplished by lengthening or shortening the drive belt where it is attached to bracket 72 on footplate 30. This adjustment will have no affect on the amount of hammer sweep or the ratio of the hammer sweep per unit of footplate movement already adjusted.

The return spring assembly 90 (shown in FIGS. 1–3 and 7–9) serves two general purposes: (a) to return the hammer 62 to a position ready for reactivation against the drum head, and (b) to allow the increase in spring tension to be greatly accelerated in the portion of the hammer sweep near the point of impact. At the same time, the return spring assembly 90 should provide a slow return rate for hammer 62 at the end of the return stroke so that the hammer 62 will not be damaged or jarred loose from its connection to the drive shaft 22.

In order to accomplish these goals, the return spring assembly 90 utilizes two sprockets 92 and 94 mounted on support member 16*a* of frame 11, with a chain 96 wrapped around both sprockets and connected to a spring 98 adjustably attached to projecting arm 28. Sprockets 92 and 94 are generally equal in size and have chain-engaging teeth 92*a* and 94*a*, respectively. Upper sprocket 92 is adjustably mounted to the end of drive shaft 22 via collar and set screw assembly 92*b*. Upper spocket 92 is mounted such that it rotates about a point spaced away from the center of its diameter, thereby producing an eccentric motion. Similarly, lower sprocket 94 is mounted for rotatable eccentric motion in the same plane as upper sprocket 92. Chain 96 is connected to upper sprocket 92, and is then wrapped around it in a counterclockwise direction. It is then wrapped in a clockwise direction around lower spocket 94 and connected to one end of coil spring 98. The other end of coil spring 98 is rotatably attached to an adjustment screw 99, journaled through projecting arm 28 of frame 11.

Figures 7, 8, 9:
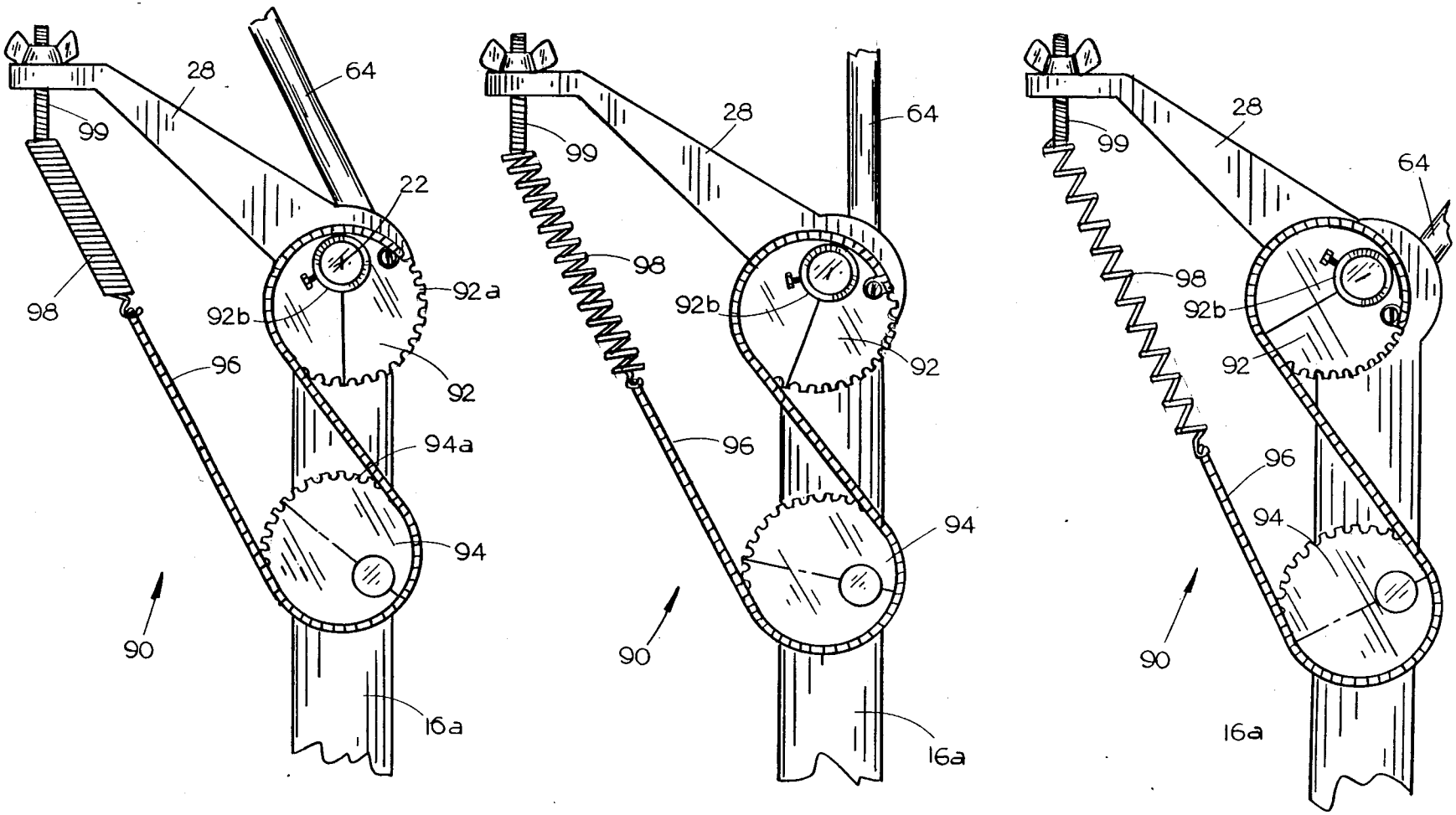
FIG. 7 is an enlarged elevational view of the right side of the invention, diagrammatically showing the hammer at rest.
FIG. 8 is an enlarged elevational view of the right side of the invention, diagrammatically showing the hammer in mid swing.
FIG. 9 is an enlarged elevational view of the right side of the invention, diagrammatically showing the hammer at its point of impact.

FIG. 7 shows the position of hammershaft 64 at the beginning of a stroke, FIGS. 8 and 9 showing the midpoint and point of impact, respectively. It can be seen that the arrangement of two eccentrically rotatable sprockets mechanically connected to spring 98 via chain 96 will cause the greatest amount of spring force to be applied in the last half of the stroke. In fact, the spring tension will be dramatically increasing up to the point of impact of the hammer 62 with the drum head. Line $D_1$ indicates the diameter of sprocket 92 which includes the greatest distance between the driveshaft 22 and the perimeter of sprocket 92. Similarly, line $D_2$ indicates the diameter of sprocket 94 which includes the greatest distance between the sprocket's 94 rotatable axis and its perimeter. Thus, FIGS. 7, 8 and 9 show that each sprocket 92 and 94 is rotating such that the distance between their respective rotatable axes and the point on their perimeters where the chain 96 is tangent, is increasing to its maximum distance of the hammer's point of impact. The specific arrangement shown in the drawings creates the greatest possible tension, such that hammer 62 will quickly return and be prepared for a second stroke. If not immediately used, the hammer 62 will retract completely to its point of rest, the tension gradually reducing so that the return is slower and softer at the resting point.

The point at which the greatest amount of spring tension acquired in relation to the smallest amount of drive shaft rotation, can be adjusted to an infinite number of settings to the comfort of the drummer. This adjustment is made by rotating the upper sprocket 92 in relation to the drive shaft 22, and/or by readjusting the chain 96 around the lower sprocket 94. Thus, the sprockets may be adjusted to begin and end a stroke in a variety of combined positions. It can be seen that the ratio of total spring tension to hammer sweep may therefore be varied to be increasing/decreasing, or a combination of the two. It can also be seen that a small amount of drive shaft rotation can build to a great amount of spring tension.

An additional adjustment to the return spring assembly 90 may be made, once the ratio of increasing/decreasing tension is determined. Since some users will prefer a large amount of spring tension throughout the entire stroke, while others will prefer a small amount (both users preferring the same rate of increasing tension), the end of the spring 98 is connected to an adjustable screw 99. By rotating screw 99 the tension of spring 98 is increased or decreased uniformly throughout the stroke.

This adjustability allows the drum pedal 10 to be easily playable without having too much power so that it is difficult to play loudly, or too little return power so that the hammer cannot be repeatedly played quickly. Also, with a conventional pedal, the shorter the hammer sweep, the less power of each stroke. Thus, the faster you play, the softer each beat gets. The special return spring assembly 90 of this invention allows quick return of the hammer during the last portion of its stroke near the point of impact, thereby allowing a greater amount of swing and more power for each stroke.

Finally, in order to simulate the feel of an acoustic drum while playing an electronic drum, the acoustic drum simulator assembly 100 has been added. When striking an acoustic drum, the plastic head on the drum stretches, such that the hammer 62 will continue in its stroke up to one-half to three-fourths of an inch beyond the point of initial impact. Because an electronic drum head is typically comprised of plastic covered plywood, the gradual slowing of the hammer 62 after impact is not present. Rather, the hammer 62 is abruptly stopped and this jolt is transmitted to the drummer's foot. Assembly 100 is designed to simulate the gradual slowing down of the hammer using the bias of a spring in place of the stretching of a drum head. The spring is a coil spring 102 through which the drive shaft 22 is inserted. One end of spring 102 is mounted to collar 68 of hammershaft arm 66, and the other end is mounted on a collar 104 which is adjustably connected to drive shaft 22. Spring 102 is wound so as to increasingly bias against continued rotation of collar 104 (and thus driveshaft 22) after hammershaft collar 68 has stopped moving forward.

When the pedal 10 is used on an electronic drum, the hammershaft collar 68 is released so as to be rotatable about drive shaft 22, and collar 104 is set in position on drive shaft 22. Thus, when the hammer 62 reaches the drum head and stops, the drive shaft 22 will continue slightly further until spring tension stops it. Thus, the "feel" of an acoustic drum is achieved while playing an electronic drum. The pedal 10 may be converted back to conventional use at any time simply by resetting hammershaft collar 68 on drive shaft 22.

It can therefore be seen that the above-described bass drum pedal accomplishes at least all of the stated objectives.

What is claimed is:

1. A bass drum pedal comprising;

a base frame;

a footplate pivotally connected at a heel end to said frame;

a pair of upstanding support members projecting from said frame supporting a generally horizontally disposed rotatable drive shaft therebetween;

a hammer assembly, including a hammer carried at the end of a shaft connected to said drive shaft;

a drive assembly connecting said footplate and drive shaft, for rotating the drive shaft to move said hammer into contact with a drum when said footplate is depressed, said drive assembly including:

(a) flexible means adjustably connecting said footplate to a first end of a torque arm adjustably connected to said drive shaft;

(b) said torque arm having a general spiral shape with a groove in its perimeter for carrying said flexible means;

(c) said torque arm adjustably connected to said drive shaft and adapted for selective adjustment within a plane perpendicular to said drive shaft; and biasing means connected to said drive shaft, for resisting rotational movement of said drive shaft.

2. The bass drum pedal as described in claim 1, wherein said torque arm is curved to a large radius at its first end, a small radius at its second end, and has a uniformly decreasing radius from its first to second ends.

3. The bass drum pedal as described in claim 1, wherein said adjustable connection of said flexible means to said torque arm includes releasable clamping means adjustably, slidably mounted on the first end of said torque arm, whereby the length of said flexible means between said footplate and the point at which the flexible means first contacts the torque arm, may be shortened or lengthened.

4. The bass drum pedal as described in claim 1, wherein the adjustable connection of said torque arm to said drive shaft includes:

(a) an adjustment arm having a first end adjustably, slidably connected to the first end of said torque arm, and a second end pivotally connected to the second end of said torque arm; and (b) a torque arm collar adjustably fastened to said drive shaft, said collar having an aperture therein through which said adjustment arm is slidably journaled and selectively fastened.

5. A bass drum pedal comprising;

a base frame;

a footplate pivotally connected at a heel end to said frame;

a pair of upstanding support members projecting from said frame supporting a generally horizontally disposed rotatable drive shaft therebetween;

a hammer assembly, including a hammer carried at the end of a shaft connected to said drive shaft;

a drive assembly connecting said footplate and drive shaft, for rotating the drive shaft to move said hammer into contact with a drum when said footplate is depressed; and biasing means connected to said drive shaft, for resisting rotational movement of said drive shaft, said biasing means including:

(a) a first sprocket adjustably mounted on said drive shaft for eccentric rotation with said drive shaft;

(b) a second sprocket rotatably mounted for eccentric rotation on one of said upstanding support members, said second sprocket spaced below and coplanar with said first sprocket;

(c) a chain connected at one end to first said sprocket and wrapped around a portion of said first sprocket in one direction, wrapped around a portion of said second sprocket in the opposite direction and connected at its other end to one end of a spring which is connected to the adjacent upstanding support member.

6. The bass drum pedal as described in claim 5, wherein said spring is adjustably connected to an arm projecting from said support member and is adapted for increasing or decreasing the bias of said spring by adjustment thereof.

7. A bass drum pedal comprising;

a base frame;

a footplate pivotally connected at a heel end to said frame;

a pair of upstanding support members projecting from said frame supporting a generally horizontally disposed rotatable drive shaft therebetween;

a hammer assembly, including a hammer carried at the end of a shaft connected to said drive shaft;

a drive assembly connecting said footplate and drive shaft, for rotating the drive shaft to move said hammer into contact with a drum when said footplate is depressed;

said footplate including:

(a) a pair of rails pivotally connected at one end to said base frame;

(b) a heel plate slidably mounted for movement along said rails adjacent the pivotable end thereof, and selectively fastened to said rails;

(c) an arch plate for supporting the arch of the foot, slidably mounted along said rails adjacent and spaced away from said heel plate, and selectively fastened to said rails;

(d) a toe plate for supporting the ball and toes of the foot, slidably mounted along said rails adjacent and spaced away from said arch plate, and selectively fastened to said rails; and biasing means connected to said drive shaft, for resisting rotational movement of said drive shaft.

8. The bass drum pedal of claim 7, wherein said pivotable connection of said rails is a hinge means adjustably mounted to said frame for selective adjustable height relative to said frame.

9. The bass drum pedal as described in claim 7, wherein the upper surface of said toe plate is contoured with a depression located for the ball of a foot, the remainder of the surface rising from the depression to the edges of the toe plate;

wherein the upper surface of said arch plate is contoured with a raised portion corresponding to the inside of the arch of a foot; and wherein the upper surface of the heel plate is contoured with a depression corresponding to the heel of a foot.

10. A bass drum pedal comprising:

a base frame;

a footplate pivotally connected at a heel end to said frame;

a pair of upstanding support members projecting from said frame supporting a generally horizontally disposed rotatable drive shaft therebetween;

a hammer assembly, including a hammer carried at the end of a shaft connected to said drive shaft;

a drive assembly connecting said footplate and drive shaft for rotating the drive shaft to move said hammer into contact with a drum when said footplate is depressed;

an acoustic drum simulator assembly, including:

(a) said hammershaft being mounted to a collar which is rotatably mounted on said drive shaft;

(b) a second collar, adjustably fastened to said drive shaft for rotation therewith; and (c) biasing means connecting said hammershaft collar and said second collar, for biasing against rotation of said second collar relative to said hammershaft collar; and biasing means connected to said drive shaft, for resisting rotational movement of said drive shaft.

11. The base drum pedal as described in claim 10, wherein said biasing means is a coil spring surrounding said drive shaft.

* * * * *